US006695423B2

(12) United States Patent
Hattori

(10) Patent No.: US 6,695,423 B2
(45) Date of Patent: Feb. 24, 2004

(54) INK JET APPARATUS, MANUFACTURING METHOD OF ORGANIC EL DISPLAY PANEL, PARAMETER DETERMINATION METHOD AND PARAMETER DETERMINATION PROGRAM

(75) Inventor: Yasuhiro Hattori, Nagoya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 0 days.

(21) Appl. No.: 10/419,097

(22) Filed: Apr. 21, 2003

(65) Prior Publication Data

US 2003/0197747 A1 Oct. 23, 2003

(30) Foreign Application Priority Data

Apr. 23, 2002 (JP) ..... 2002-120617

(51) Int. Cl.[7] ..... B41J 24/38; B41J 2/205; B41J 3/407; B41J 2/01

(52) U.S. Cl. ..... 347/9; 347/9; 347/15; 347/106; 347/107; 349/106

(58) Field of Search ..... 347/9, 106, 107; 349/106

(56) References Cited

U.S. PATENT DOCUMENTS 5,847,723 A * 12/1998 Akahira et al. ..... 347/14
6,158,858 A 12/2000 Fujiike et al.
6,164,746 A * 12/2000 Akahira et al. ..... 347/15
6,290,352 B1 9/2001 Marumoto et al.
6,471,352 B2 10/2002 Akahira

FOREIGN PATENT DOCUMENTS

| | | |
|---|---|---|
| EP | 0 963 844 A1 | 12/1999 |
| JP | 10-315510 | 12/1998 |
| JP | 31106110 B2 | 9/2000 |
| JP | 2001-228320 | 8/2001 |
| JP | 2001-301203 | 10/2001 |

* cited by examiner

*Primary Examiner*—Stephen D. Meier
*Assistant Examiner*—Alfred Dudding
(74) *Attorney, Agent, or Firm*—Oliff & Berridge, PLC

(57) ABSTRACT

An ink jet apparatus which is easy to change parameters of a driving signal to be applied to an ink jet head depending on desired ink drop volume is provided. In steps S22, S24, S26 and S13, reference voltage es, reference frequency fs and waveform parameter are modified. Based on these modified parameters, the reference volume cs modified in step S16 is compared in step S17 with unit volume ci inputted in step S11. The modification of the reference parameters and the reference volume cs, and comparison between the reference volume cs and the unit volume ci are repeated till a difference is equal to or lower than a predetermined threshold. The respective reference parameters when the difference is equal to or lower than the predetermined threshold are determined as the parameters of the driving signal.

25 Claims, 5 Drawing Sheets

FIG. 4

| | | | |
|---|---|---|---|
| 1ST WAVEFORM | t1: 5<br>t2: 5<br>t3: 5<br>(μs) | REFERENCE VOLTAGE<br>es (V) 25<br>LOWER LIMIT 20<br>UPPER LIMIT 30<br>REFERENCE FREQUENCY<br>fs (kHz) 0.3<br>LOWER LIMIT 1<br>UPPER LIMIT 5 | VOLTAGE COEFFICIENT<br>Δe (pL/V) 2.54<br>FREQUENCY COEFFICIENT<br>Δf (pL/1KHz) 3.45<br>REFERENCE VOLUME<br>Cs (V) 26.4 |
| 2nd WAVEFORM | t1: 12<br>t2: 4<br>t3: 6<br>(μs) | REFERENCE VOLTAGE<br>es (V) 32<br>LOWER LIMIT 26<br>UPPER LIMIT 38<br>REFERENCE FREQUENCY<br>fs (kHz) 0.3<br>LOWER LIMIT 1<br>UPPER LIMIT 5 | VOLTAGE COEFFICIENT<br>Δe (pL/V) 1.14<br>FREQUENCY COEFFICIENT<br>Δf (pL/1KHz) 2.05<br>REFERENCE VOLUME<br>Cs (V) 32.1 |
| 3rd WAVEFORM | t1: 10<br>t2: 19<br>t3: 7<br>(μs) | REFERENCE VOLTAGE<br>es (V) 34<br>LOWER LIMIT 28<br>UPPER LIMIT 38<br>REFERENCE FREQUENCY<br>fs (kHz) 0.3<br>LOWER LIMIT 1<br>UPPER LIMIT 5 | VOLTAGE COEFFICIENT<br>Δe (pL/V) 0.86<br>FREQUENCY COEFFICIENT<br>Δf (pL/1KHz) 1.53<br>REFERENCE VOLUME<br>Cs (V) 42.4 |

INK JET APPARATUS, MANUFACTURING METHOD OF ORGANIC EL DISPLAY PANEL, PARAMETER DETERMINATION METHOD AND PARAMETER DETERMINATION PROGRAM

BACKGROUND OF THE INVENTION (i) Technical Field of the Invention

This invention relates to an ink jet apparatus which ejects ink from a nozzle of an ink jet head to color a target object.

(ii) Description of the Related Art

In recent years, various methods for manufacturing organic EL (Electro Luminescence) display panels and panels for color filters of liquid crystal displays (LCD), by means of an ink jet apparatus have been introduced.

For instance, the Unexamined Patent Publication No. 2001-228820 discloses a method for manufacturing a color filter based on data representing manufacturing conditions, such as total ink volume supplied to a filter element, volume per ink drop ejected from a nozzle (ejected liquid amount), a main scanning frequency and a sub-scanning amount, provided beforehand per color filter of various types. This method simply requires modification of the data representing the manufacturing conditions when the user wishes to manufacture another type of color filter. Therefore, substantial reduction of the time required for initial setups was achieved.

In manufacturing of the organic EL display panels and panels for color filters of LCD by means of an ink jet apparatus, the most important parameters are the thickness of a film formed with ink, and then, the position where the film is formed. Accordingly, there has been a demand that the thickness of the film be arbitrarily adjusted even when the same type of panel is manufactured.

Generally, the thickness of the film formed with ink is uniquely defined depending on the number of ink drops ejected per unit area and volume per ink drop. Therefore, adjustment of the volume per ink drop ejected from a nozzle of an ink jet head is merely required in order to control the thickness of the film. In the ink jet apparatus, modification of the volume per ink drop from the nozzle is possible by increasing or decreasing parameters (such as driving voltage, driving frequency, waveform, for example) of a driving signal applied to the ink jet head. Accordingly, the thickness of film can be controlled by adjustment of the parameters of the driving signal.

However, in the aforementioned manufacturing method, manufacturing conditions are fixed pet color filter type. The manufacturing conditions, that is, parameters of the driving signal, are the same when the color filter of the same type is manufactured. Therefore, modification of the ink drop volume was not easy. The volume per ink drop can be changeable if a number of manufacturing conditions which differ in the ink drop volume are prepared for the same color filter, for example. However, it is not practical to prepare such a lot of data per manufacturing conditions since it requires enormous time and labor. If the data are not prepared, the user has to set the parameters. Thus a load to the user is heavy and the user operation becomes complex.

SUMMARY OF THE INVENTION

One object of the present invention is to provide an ink jet apparatus, a parameter determination method and a manufacturing method of organic EL display panel, that allow the user to modify parameters of a driving signal applied to an ink jet head with ease without provision of plural data per manufacturing conditions depending on desired ink drop volume. Another object of the present invention is to provide a parameter determination program for use in the ink jet apparatus, parameter determination method and manufacturing method of organic EL display panel.

In order to attain the above objects, an ink jet apparatus of the present invention is provided with an ink jet head having a nozzle for ejecting ink drops and capable of increasing or decreasing ink drop volume ejected from the nozzle depending on parameters of a driving signal applied. The ink jet apparatus comprises a volume input device for inputting unit volume representing total ink drop volume to be ejected within a unit area, a parameter determination device for determining the parameters of the driving signal to be applied to the ink jet head based on the unit volume inputted by the volume input device, and a reference volume calculation device for calculating reference volume representing total ink drop volume ejected within the unit area when a reference driving signal having reference parameters is applied to the ink jet head. The parameter determination device modifies the reference parameters so that a difference between the reference volume and the unit volume is equal to or lower than a predetermined threshold, and determines the modified reference parameters as the parameters of the driving signal to be applied to the ink jet head.

The ink jet apparatus constituted as above allows the user to modify the parameters of the driving signal applied to the ink jet head easily based on the desired unit volume inputted by the volume input device.

In this ink jet apparatus, the parameter determination device modifies the reference parameters, and compares the reference volume calculated by the reference volume calculation device based on the modified reference parameters with the unit volume inputted by the volume input device. The modification of the reference parameters, calculation of the reference volume by the reference volume calculation device, and comparison between the reference volume and the unit volume are repeated till the difference is equal to or lower than the predetermined threshold. In this way, the reference parameters that allow the difference to be equal to or lower than the predetermined threshold are easily obtained as a result of input of desired unit volume by the volume input device. The user can easily determine the parameters of the driving signal to be applied to the ink jet head which enables forming of the film with desired thickness even if he/she is not skilled in the operations of the ink jet apparatus.

The ink jet apparatus of the present invention further comprises an interval input device for inputting a unit interval representing an interval of the unit areas. The parameter determination device determines the parameters of the driving signal to be applied to the ink jet head based on the unit volume and the unit interval.

The ink jet apparatus constituted as above allows the parameter determination device to determine the parameters of the driving signal to be applied to the ink jet head based on not only the unit volume inputted by the volume input device but also the unit interval inputted by the interval input device.

The unit interval is a traveling distance from one unit area to another in a scanning direction of the ink jet head when the ink jet head scans a target object along its surface while ejecting ink drops. The parameter determination device determines the parameters which allow the unit volume to be ejected at a desired unit interval as the parameters of the driving signal to be applied to the ink jet head. Therefore, forming of the film with desired thickness is possible regardless of a pixel interval.

There is no limitation in the mechanism for modifying the reference parameters by the parameter determination device. However, it is preferable that the parameter determination device modifies the reference parameters by increasing or decreasing the reference parameters within a range of upper and lower limits preset to the reference parameters, for example.

With the ink jet apparatus constituted as such, modification of the reference parameters is possible by increasing or decreasing the reference parameters within the range of upper and lower limits preset to the reference parameters with which the ink jet head is operable in favorable condition.

It is preferable that the reference driving signal has n types of the reference parameters ($1^{st}$ to $n^{th}$ reference parameters), and that the parameter determination device increases or decreases one or more types of the reference parameters, among the n types of the reference parameters, within a range of upper and lower limits preset per type of the reference parameters.

Then, it is possible to increase or decrease one or more reference parameters for modification among the n types of the reference parameters of the driving signal, and determine the n types of the reference parameters including the modified reference parameter(s) as the parameters of the driving signal to be applied to the ink jet head.

In the present ink jet apparatus, the parameter determination device modifies the reference parameters by increasing or decreasing one or more types of the reference parameters. Then, based on the n types of the reference parameters including the modified reference parameters, the parameter determination device compares the reference volume calculated by the reference volume calculation device with the unit volume inputted by the volume input device. The modification of the reference parameters, calculation of the reference volume by the reference volume calculation device; and comparison between the reference volume and the unit volume are repeated until the difference is equal to or lower than the predetermined threshold. In this way, appropriate reference parameters that allow the difference to be equal to or lower than the predetermined threshold is obtained respectively as a result of input of desired unit volume by the volume input device. The user can reasonably determine the parameters of the driving signal to be applied to the ink jet head which enables forming of the film with desired thickness.

The parameter determination device may be designed to increase or decrease only one type of the reference parameters at a time or multiple types of the reference parameters simultaneously, when increasing or decreasing one or more types of the reference parameters. There is no limitation regarding the design when only one type of the reference parameters is increased or decreased at a time. However, it is preferable that the parameter determination device increases or decreases at least one of the reference parameters other than the $i^{th}$ reference parameter by a predetermined amount and then increases or decreases the $i^{th}$ reference parameter within the range of upper and lower limits, when the difference between the reference volume and the unit volume is more than the predetermined threshold even if the $i^{th}$ ($in \leqq n$) reference parameter is increased or decreased to its upper or lower limit.

With the ink jet apparatus constituted as above, the reference parameters which have much effect on reducing the difference between the reference volume and the unit volume to be equal to or lower than the threshold can be reasonably determined as the parameters of the driving signal to be applied to the ink jet head within the range of upper and lower limits with which the ink jet is operable in favorable condition.

It is preferable that the parameter determination device increases or decreases at least one of the reference; parameters other than the $i^{th}$ reference parameter by the predetermined amount and modifies one or both of the upper and lower limits for the $i^{th}$ reference parameter according to the amount increased or decreased, and then increases or decreases the $i^{th}$ reference parameter within the range of upper and lower limits.

Such an ink jet apparatus can modify, the upper or lower limit of the $i^{th}$ reference parameter according to the amount increased or decreased when any of the reference parameters other than the $i^{th}$ reference parameter are increased or decreased by the predetermined amount. Accordingly, the $i^{th}$ reference parameter can be increased or decreased within a different range of upper and lower limits before and after the increase or decrease of the any of the reference parameters other than the $i^{th}$ reference parameter.

There may be another design when one type of the reference parameters is increased or decreased at a time. That is, the parameter determination device may be designed to increase or decrease the i+1 parameters, when the difference between the reference volume and the unit volume is more than the predetermined threshold even if the $i^{th}$ ($i \leqq n$) parameter is increased or decreased to its upper or lower limit.

Consequently, even if the difference between the reference volume and the unit volume is not reduced to be equal to or lower than the threshold by the increase or decrease of the $i^{th}$ reference parameter, the parameter determination device can determine the reference parameters of the driving signal to be applied to the ink jet head which reduce the difference to be equal to or lower than the threshold by increasing or decreasing the i+1 reference parameter sequentially. In this case, prompt determination of desired parameters is possible since adjustments of the reference parameters are simple.

In the present ink jet apparatus, the difference between the reference volume and the unit volume cannot be reduced to be equal to or lower than the threshold if all the reference parameters are increased or decreased to their upper or lower limit before the difference between the reference volume and the unit volume is reduced to be equal to or lower than the threshold. Then, there is a fear that the parameters of the driving signal to be applied to the ink jet head cannot be determined.

To avoid the above, it is preferable that the parameter determination device determines the reference parameters modified to minimize the difference between the reference volume and the unit volume as the parameters of the driving signal to be applied to the ink jet head, when the reference parameters cannot be modified to reduce the difference between the reference volume and the unit volume to be equal to or lower than the predetermined threshold.

The parameter determination device of the ink jet apparatus determines at least a driving voltage which is a parameter of the driving signal to be applied to the ink jet head based on the unit volume.

The parameter determination device of the ink jet apparatus further determines at least a driving frequency which is a parameter of the driving signal based on the unit volume.

In the ink jet apparatus of the present invention, the volume input device inputs the unit volume for ink of organic EL (Electro Luminescence) material as the unit volume, and the reference volume calculation device calculates reference volume for ink of the organic EL material as the reference volume.

Another aspect of the present invention provides a method for manufacturing organic EL display panel with an ink jet head having a nozzle for ejecting ink drops and capable of increasing and decreasing ink drop volume ejected from the nozzle based on parameters of a driving signal applied. The method comprises steps of: inputting unit volume, representing total ink drop volume to be ejected within a unit area, of ink of the organic EL material; calculating reference volume, representing total ink drop volume ejected within the unit area, of ink of the organic EL material when a reference driving signal having reference parameters representing a basis is applied to the ink jet head; modifying the reference parameters so that a difference between the unit volume and the reference volume is equal to or lower than a predetermined threshold and determining the modified reference parameters as the parameters of the driving signal to be applied to the ink jet head; and driving the ink jet head with the driving signal having the parameters determined in the aforementioned parameter determining step.

Such a method is suitable for manufacturing organic EL display panel using the aforementioned ink jet apparatus.

The method for manufacturing organic EL display panel further comprises a step of inputting a unit interval representing an interval of the unit areas. In the parameter determining step, the parameters of the driving signal to be applied to the ink jet head are determined based on the unit volume and the unit interval.

In this method for manufacturing organic EL display panel, the reference parameters are modified by increasing or decreasing the reference parameters within a range of upper and lower limits preset to the reference parameters in the parameter determining step.

In this method, the reference driving signal has n types of the reference parameters ($1^{st}$ to $n^{th}$ reference parameters), and that one or more types of the reference parameters are increased or decreased within a range of upper and lower limits preset to each of the n types of the reference parameters in the parameter determining step.

It is preferable that at least one of the reference parameters other than the $i^{th}$ ($i \leqq n$) reference parameter is increased or decreased by a predetermined amount and then the $i^{th}$ reference parameter is increased or decreased within the range of upper and lower limits, when the difference between the reference volume and the unit volume is more than a predetermined threshold even if the $i^{th}$ reference parameter is increased or decreased to its upper or lower limit in the parameter determining step.

It is further preferable that at least one of the reference parameters other than the $i^{th}$ reference parameter is increased or decreased by a predetermined amount and one or both of the upper and lower limits of the $i^{th}$ reference parameter are changed according to the amount increased or decreased in the parameter determining step, and then the $i^{th}$ reference parameter is increased or decreased within the range of upper and lower limits.

In this method, the $(i+1)^{th}$ reference parameter is increased or decreased when the difference between the reference volume and the unit volume is more than the predetermined threshold even if the $i^{th}$ ($i \leqq n$) reference parameter is increased or decreased to its upper or lower limit in the parameter determining step.

Furthermore, the reference parameters modified to minimize the difference between the reference volume and the unit volume are determined as the parameters of the driving signal to be applied to the ink jet head, when the reference parameters cannot be modified so that the difference between the reference volume and the unit volume is equal to or lower than the predetermined threshold in the parameter determining step.

It is preferable that at least a driving voltage representing a parameter of the driving signal to be applied to the ink jet head is determined based on the unit volume in the parameter determining step.

It is further preferable that at least a driving frequency representing a parameter of the driving signal to be applied to the ink jet head is determined based on the unit volume in the parameter determining step.

The aforementioned method for manufacturing organic EL display panel comprises every step and characteristic corresponding to the devices and characteristics that the aforementioned ink jet apparatus may have. Therefore, it is suitable for manufacturing organic EL display panel using the aforementioned ink jet apparatus.

Another aspect of the present invention provides a method for determining parameters of a driving signal to be applied to an ink jet head of an ink jet apparatus. The ink jet head has a nozzle for ejecting ink drops and capable of increasing and decreasing ink drop volume ejected from the nozzle based on the parameters of the driving signal applied. In the method, reference volume representing total ink drop volume ejected within a unit area is calculated when a reference driving signal having reference parameters representing a basis is applied to the ink jet head. Furthermore, the reference parameters are modified so that a difference between the calculated reference volume and the unit volume representing total ink drop volume to be ejected within the unit area is equal to or lower than a predetermined threshold, and the modified parameters are determined as the parameters of the driving signal to be applied to the ink jet head.

Moreover, in this method, the reference volume for ink of organic EL material is calculated and the reference parameters are modified so that the difference between the calculated reference volume and the unit volume representing total ink drop volume of organic EL material to be ejected within the unit area is equal to or lower than the predetermined threshold and the modified parameters are determined as the parameters of the driving signal to be applied to the ink jet head.

An ink jet apparatus which determines parameters of a driving signal using the above method is designed to have the same functions as the aforementioned ink jet apparatus. Therefore, the same effects and advantages as the aforementioned ink jet apparatus can be achieved.

Another aspect of the present invention provides a parameter determination program that controls an ink jet apparatus. The ink jet apparatus is provided with an ink jet head having a nozzle for ejecting ink drops and capable of increasing and decreasing ink drop volume ejected from the nozzle based on the parameters of the driving signal applied. This program makes a computer system calculate reference volume representing total ink drop volume ejected within a unit area when a reference driving signal having reference parameters representing a basis is applied to the ink jet head, and then makes the computer system modify the reference parameters so that a difference between the reference volume calculated in the reference volume calculating step and unit volume representing total ink drop volume to be ejected within the unit area is equal to or lower than a predetermined threshold and to determine the modified reference parameters as the parameters of the driving signal to be applied to the ink jet head.

A computer system which determines parameters of a driving signal by the above parameter determination program can be a part of the aforementioned ink jet apparatus. The parameter determination program is suitable for performing the aforementioned method for manufacturing organic EL display panel using the computer system or the aforementioned ink jet apparatus.

The parameter determination program calculates the reference volume for ink of organic EL material, and modifies the reference parameters so that the difference between the calculated reference volume and the unit volume representing total ink drop volume for ink of organic EL material to be ejected within the unit area is equal to or lower than the predetermined threshold and determines the modified parameters as the parameters of the driving signal to be applied to the ink jet head.

A computer system which determines parameters of a driving signal by the above parameter determination program can be a part of the aforementioned ink jet apparatus.

The aforementioned parameter determination program is supplied to a computer system, ink jet apparatus, or user who utilizes the foregoing, via recording media such as a FD, CD-ROM, etc. and communication network such as radio and wireless networks, for example.

The computer system which executes the parameter determination program may be a computer system comprising the CPU of the aforementioned ink jet apparatus, or another computer system connected to the ink jet apparatus via radio and wireless networks for example.

BRIEF DESCRIPTION OF THE DRAWING

The invention will now be described, by way of example, with reference to the accompanying drawings, in which:

FIG. 4 show parameter tables; and

DETAILED DESCRIPTION OF PREFERRED EMBODIMENT

Overall Constitution

Figure 1:
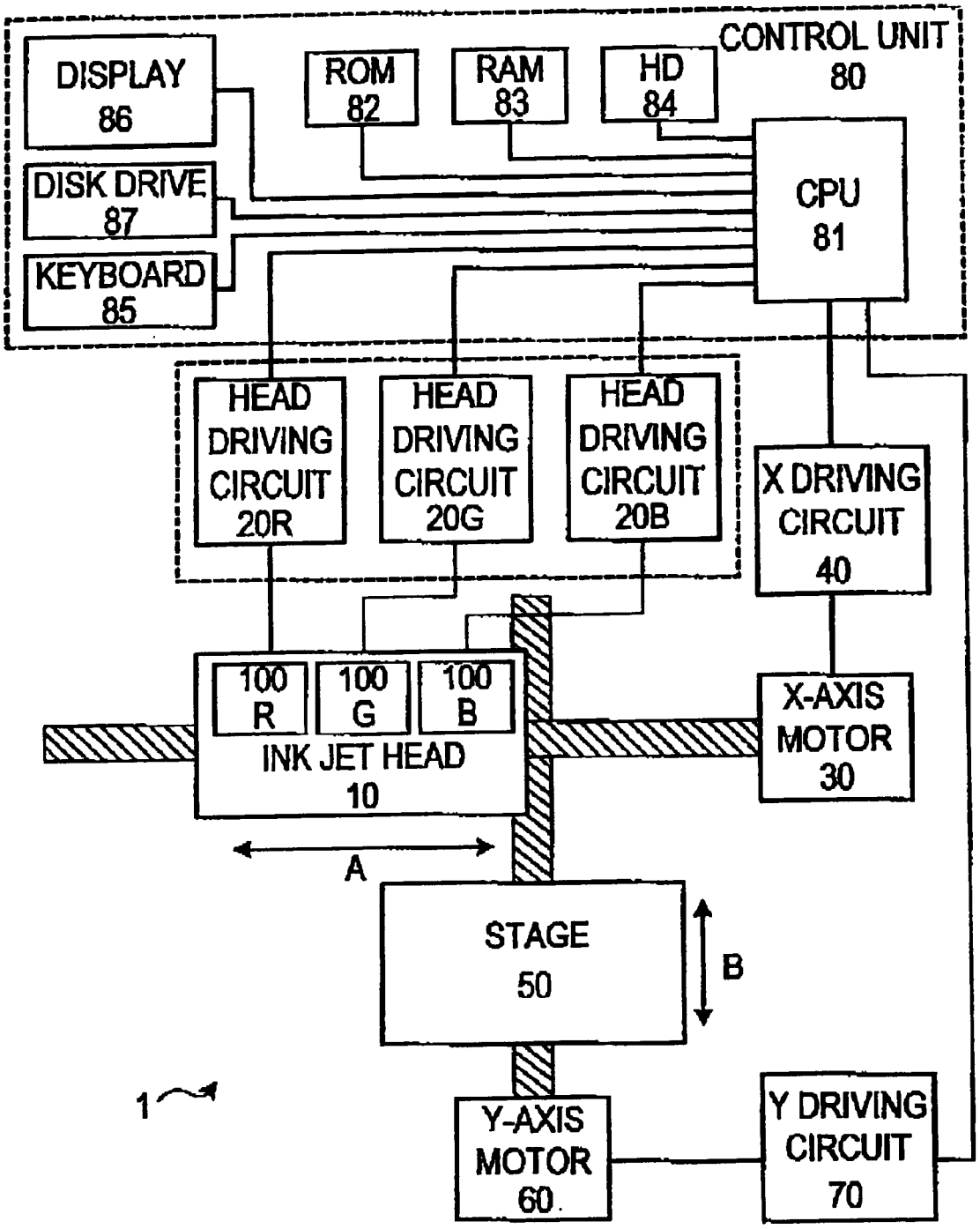
FIG. 1 is a block diagram showing a constitution of an ink jet apparatus as a whole.

As shown in FIG. 1, an ink jet apparatus 1 comprises an ink jet head (hereinafter, simply referred to as a head) 10, a head driving circuit 20 for supplying a driving signal to the head 10, an x-axis motor 30 for shifting the head 10 to an x-axial direction (a lateral direction in FIG. 1; see an arrow A), an x driving circuit 40 for driving the x-axis motor, a stage 50 for attaching a target object to be colored thereon, a y-axis motor 60 for shifting the stage 50 to a y-axial direction (a vertical direction in FIG. 1; see an arrow B), a y driving circuit 70 for driving the y-axis motor 60, a control unit 80 for controlling the ink jet apparatus 1, etc. This ink jet apparatus 1 ejects ink drops from the head 10 while changing the positions of the head 10 and the stage 50 relative to each other using the x-axis motor 30 and the y-axis motor 60, to form a film over the target object attached on the stage 50.

The head 10 comprises independent head units 100 per color. In the present embodiment, the head 10 comprises head units 100R, 100G and 100B which correspond to three colors of red (R), green (G) and blue (B), respectively.

Figure 2A:
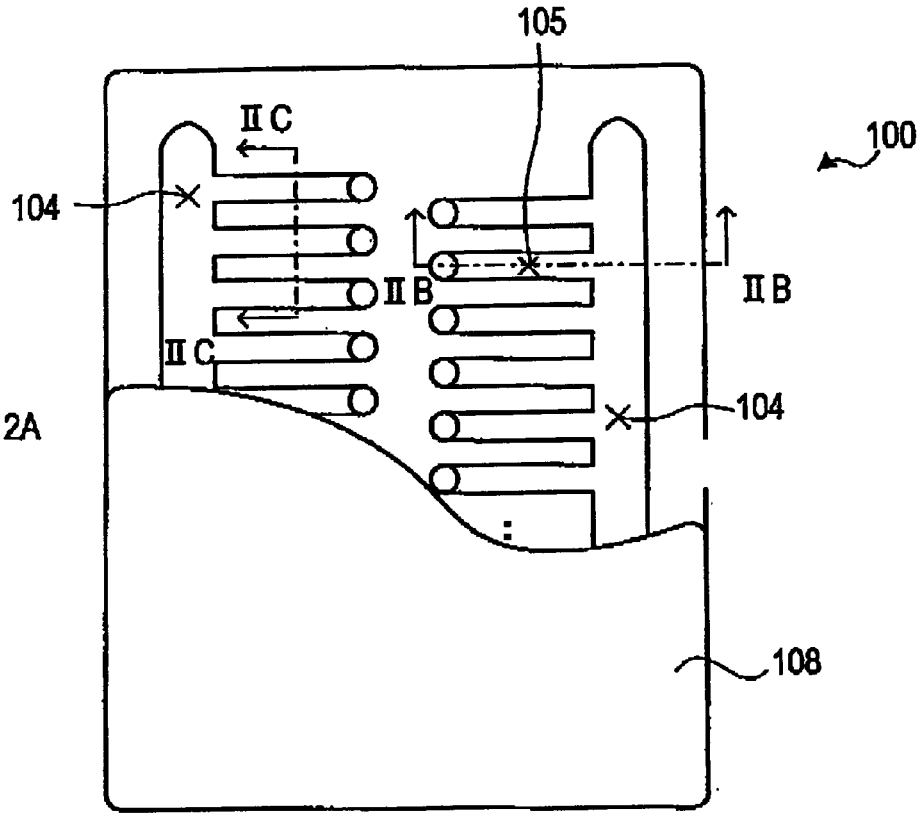
FIG. 2A is a top view showing a constitution of a head unit.
Figure 2B:
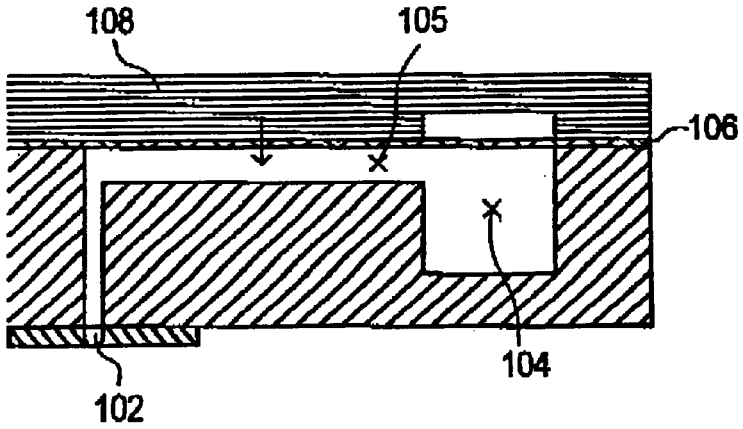
FIG. 2B is a cross sectional view taken along the line IIB—IIB in FIG. 2A.
Figure 2C:
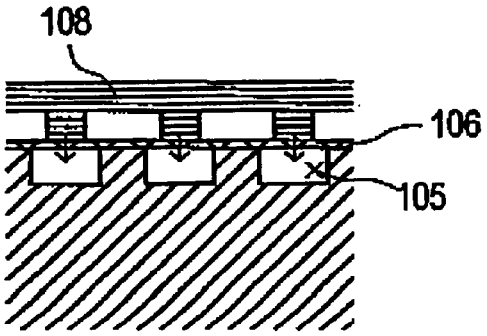
FIG. 2C is a cross sectional view taken along the line IIC—IIC in FIG. 2A.

Each of the head units 100 of the head 10 comprises a nozzle 102 for ejecting ink drops, an ink passage 104 and a pressure chamber 105 for leading ink supplied from a not shown ink tank to the nozzle 102, a piezoelectric element 108 for narrowing and expanding the pressure chamber 105 via a diaphragm 106, etc., as shown in FIG. 2.

The piezoelectric element 108 contracts to expand the pressure chamber 105, when the voltage level of the driving signal (hereinafter, referred to as driving voltage level) inputted from the head driving circuit 20 is HIGH. As a result, the pressure chamber 106 is expanded and ink flows into the pressure chamber 105 via the ink passage 104 from the ink tank. When the driving voltage level changes from HIGH to LOW, the piezoelectric element 108 discharges stored electricity and expands so as to narrow the pressure chamber 105 (see arrows in FIGS. 2B and 2C). As a result, the pressure chamber 105 is narrowed and ink drops are ejected from the nozzle 102 through the pressure chamber 105. Plural sets (128 sets in the present embodiment) of the piezoelectric element 108, pressure chamber 106 and nozzle 102 are provided in each of the head units 100. The driving signal is inputted to the respective piezoelectric elements 108 individually from the head driving circuit 20.

Figure 3:
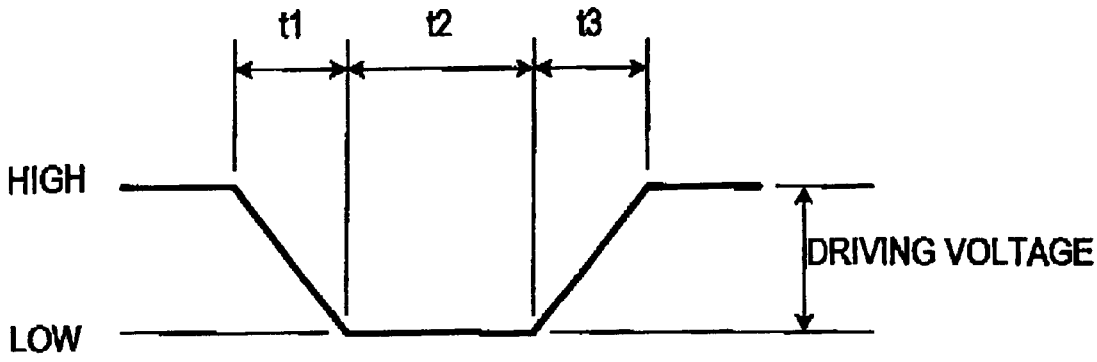
FIG. 3 is a diagram showing a waveform of a driving signal.

In the head units 100, volume per ink drop to be ejected from the nozzle 102 is varied depending on parameters of the driving signal inputted from the head driving circuit 20. The parameters of the driving signal include a driving voltage, a frequency of the driving signal (hereafter, referred to as driving frequency parameter), a waveform parameter, etc. The larger values the driving voltage and driving frequency hate, the larger the volume per ink drop ejected from the nozzle 102 is. It is known by way of experiment that the above relation between the values of the driving voltage and driving frequency and the volume per ink drop shows direct proportion within a certain range. The waveform parameter, as shown in FIG. 3, indicates a form of a waveform determined by a discharging time t1 required to change the driving voltage level from HIGH to LOW, a holding time t2 during which the driving voltage level is kept LOW, a charging time t3 required to increase the driving voltage level from LOW to HIGH, etc. It is experimentally known that as the sum of the discharging time t1 and holding time t2 becomes larger, the driving voltage and driving frequency are increased, and the volume per ink drop ejected from the nozzle 102 is gradually increased.

The head driving circuit 20 comprises driving circuits 20R, 20G and 20G corresponding to the head units 100R, 100G and 100B per color, respectively. The head driving circuit 20 generates the driving signal having the parameters of the driving voltage, driving frequency and waveform parameter set by a control signal when the control signal is inputted from the control unit 80, and outputs the driving signal to the respective piezoelectric elements 108.

The control unit 80 comprises a CPU 81 for controlling the ink jet apparatus 1 as a whole, a ROM 82 for storing the processing steps, etc. of the CPU 81, a RAM 83 for storing results of the processes performed by the CPUJ 81, a hard disk (hereafter, referred to as HD) 84, a keyboard 85, a display 86, a disk drive 87, etc.

The CPU 81 of the control unit 80 operates the x driving circuit 40 and x-axis motor 30 and the y driving circuit 70 and y-axis motor 60 with a control program stored in the ROM 82, and controls movements of the head 10 and stage 50. In this respect, the head 10 is controlled to be moved relative to the stage 50 along a locus specified by locus data stored in the HD 84. The CPU 81 outputs the control signal generated in a later-described parameter determination process (FIG. 5) to the head driving circuit 20 when the head 10 is moved relative to the stage 50.

The HD 84 stores parameter tables in which parameters to be a basis of the driving signal inputted to the head 10 (hereafter, referred to as reference parameters) are stored. The parameter tables, as shown in FIG. 4, are created per type of the waveform parameter (in the present embodiment, $1^{st}$ to $3^{rd}$ waveforms). Each of the parameter tables includes a driving voltage es and a driving frequency fs to be the basis (hereafter, referred to as reference voltage and reference frequency), reference volume cs representing volume per ink drop ejected from the head 10 to which the driving signal (i.e. reference driving signal in the present invention) having the reference voltage es and reference frequency fs was inputted, an adjustable range within which the reference voltage es and reference frequency fs can be increased or decreased (upper limits eup, fup and lower limits elow, flow), a voltage coefficient Δe and a frequency coefficient Δf, etc. The adjustable range is a range (range of the upper limit and the lower limit) within which the reference volume cs is increased or decreased in proportion to the driving voltage and driving frequency.

The voltage and frequency coefficients Δe and Δf are used in the later-described parameter determination process (FIG. 5) upon modification of the reference volume cs. They are the values indicating a varying amount of the reference volume which varies together with the change of the reference voltage es and reference frequency fs.

The reference parameters stored in the parameter tables are preset per type of ink to be used for coloring of the target object. In the present embodiment, the reference parameters for ink of organic EL material to be used when coloring to a display panel is performed are stored. An organic EL display panel can be manufactured by coloring a display panel with ink of organic EL material.

Parameter Determination Process of CPTU 81

The parameter determination process to be performed by the CPU 81 of the control unit 80 is explained below by way of FIG. 5. This parameter determination process is started when a predetermined operation to start the parameter determination process is made to the keyboard 85.

The CPU 81 performs an input process of unit volume ci and a unit interval pi (S11). In this step, the CPU 81 displays an image on the display 86 for receiving inputs of the unit volume ci (pL) representing total ink volume to be ejected within a unit area and the unit interval pi (μm) representing an interval of unit areas. The CPU 81 stands by until the unit volume ci and unit interval pi are inputted. When the unit volume ci and unit interval pi are inputted, the process moves to the next step. The unit area represents, for example, an area forming each pixel (dot) in a display panel when it is assumed that the target object is the display panel. The unit interval represents an interval of the unit areas in a traveling direction of the head to which is moved along the surface of the target object while ejecting ink drops. When the target object is assumed to be a display panel, the unit interval indicates a distance from one pixel to another (or width of each pixel). In the following steps, the parameters which allows ejection of ink of the unit volume ci at the unit interval pi when the head is moved along the surface of the target object are determined to be the parameters of the driving signal.

In the next step, the CPU 81 initializes a variable N (S12). In this step, the variable N is set to "1" (1→N). This variable N is used to identify the waveform parameter in the subsequent steps. The variable N holds a value "n" in the subsequent steps.

The CPU 81 reads the reference parameters of the. $n^{th}$ waveform (S13). In this step, the reference voltage as (V), reference frequency fs (kHz), reference volume cs (pL), voltage coefficient Δe, frequency coefficient Δf and adjustable range (upper limits eup, fup and lower limits elow, flow) are read among the reference parameters of the $n^{th}$ waveform stored in the parameter tables. The reference voltage es is set to a variable E. The variable E holds the reference voltage es or a value "e" which is a modified value of the reference voltage es.

The CPU 81 initializes variables M and D (S14) In this step, the variable M is set to "1" (1→M), and the variable D is set to a value representing a difference between the unit volume ci inputted in step S11 and the reference volume cs read in step S13 (|ci−cs|→D). The variable M holds a value "m" which represents the number of ink drops to be ejected within the unit area.

The CPU 81 modifies the reference frequency fs (S15). In this step, a frequency f (=m*vh/pi (kHz)), calculated based on the unit interval pi (μm) inputted in step S11, the value "m" in the variable M and a scanning speed vh (μm/s) representing the traveling speed of the head 10, is set in a variable F as a new reference frequency fs. The variable F holds the reference frequency fs or a value "f" which is a modified value of the reference frequency fs.

The CPU 81 modifies the reference volume cs (S16). In this step, the CPU 81 calculates the varying amount of the reference volume ce due to the modification of the reference voltage es, based on the reference voltage es and voltage coefficient Δe read in step S13 and the value "e" in the variable E. Here, a difference between the reference voltage es read in step S13 and the value "e" in the variable E (=es−e) is calculated as the varying amount due to the reference voltage es. Then, the varying amount is multiplied by the voltage coefficient Δe (=(es−e)*Δe) to obtain the varying amount of the reference volume cs due to the modification of the reference voltage es. Subsequently, the varying amount of the reference volume es due to the modification of the reference frequency fs is calculated based on the reference frequency fs and frequency coefficient Δf read in step S13 and the value "f" in the variable F. Here, a difference between the reference frequency fs read in step S13 and the value "f" in the variable F (=fs−f) is calculated as the varying amount due to the modification of the reference frequency fs. Then, the varying amount is multiplied by the frequency coefficient Δf (=(fs−f)*Δf) to obtain the varying amount of the reference volume cs due to the modification of the reference frequency fs. Then, the respective varying amounts and the reference volume cs are added (=cs+((es−e)*Δe)+((fs−f)*Δf)) to obtain a new reference volume cs.

In the next step the CPU 81 checks whether the difference between the unit volume ci inputted in step S11 and the reference volume cs modified in step 516 is equal to or lower than a predetermined threshold (|ci−cs|≦th) (S17). The threshold th is a predetermined value (0.5 (pL) in the present embodiment), but can be a value that can be changed arbitrarily.

In step S17, if the difference between the unit volume ci and the reference volume cs is larger than the threshold th (S17: NO), the CPU 81 checks whether the value (|ci−cs|) representing the difference between the unit volume ci and the reference volume cs is smaller than the value "d" in the variable D (|ci−cs|<d) (S18).

In step S18, if the value (|ci−cs|) representing the difference between the unit volume ci and the reference volume cs is smaller than the value "d" in the variable D (|ci−cs|<d) (S18: YES), the CPU 81 sets the value of the difference in the variable D (|ci−cs|→D) (S19). Hereafter, step S19 is repeated, and consequently the variable D holds a minimum value of the difference between the unit volume ci and the reference volume cs.

The CPU 81 sets the value "e" in the variable E in a variable Min[0] (E→Min[0]), sets the value "f" in the variable F in a variable Min[1] (F→Min[1]), and sets the value "n" in the variable N in a variable Min[2] (S20). Hereafter, step S20 is repeated and thus the variables Min [0]–[2] hold the reference voltage es, reference frequency fs and value "n" in the variable N with which the difference between the unit volume ci and the reference volume cs is the smallest.

After step 20 is over, or if the value representing the difference between the unit volume ci and the reference volume cs is equal to or larger than the value "d" in the variable D (d≦|ci−cs|) (S18: NO), the CPU 81 checks whether the reference voltage es is modifiable (S21). In this step, whether the reference voltage es is modifiable or not is checked based on conditions which differ in which the reference volume cs is larger than the unit volume ci and which the reference volume cs is smaller than the unit volume ci.

When the reference volume cs is larger than the unit volume ci (ci<cs), it is necessary to reduce the reference volume cs by decreasing the reference parameters. In order to reduce the reference voltage es, the reference voltage es has to be larger than the lower limit elow read in step S13. Accordingly, if the value "e" in the variable E representing the reference voltage es is larger than the lower limit elow (elow<e), it is possible to further reduce the reference voltage es. The reference voltage es is determined modifiable. If the value "e" in the variable E representing the reference voltage es is equal to or lower than the lower limit elow (e≦elow), it is not possible to further reduce the reference voltage es. The reference voltage es is determined not modifiable.

On the other hand, if the reference volume cs is smaller than the unit volume ci (ci>cs), it is necessary to increase the reference voltage cs by increasing the reference parameters. In order to increase the reference voltage es, the reference voltage es has to be smaller than the upper limit eup read in step S13. Accordingly, if the value "e" in the variable E representing the reference voltage es is smaller than the upper limit eup (e<eup), it is possible to further increase the reference voltage es. The reference voltage es is determined modifiable. If the value "e" in the variable E representing the reference voltage es is equal to or larger than the upper limit eup≦e), it is not possible to further increase the reference voltage es. The reference voltage es is determined not modifiable.

If the reference voltage es is determined modifiable in step S21 (S21: YES), the CPU 81 modifies the reference voltage es (S22). If the reference voltage Cs is larger than the unit volume ci (ci<cs), a value obtained by subtracting "1 (V)" from the variable E is set in the variable B as a new reference voltage es (E−1→E). On the other hand, it the reference volume cs is smaller than the unit volume ci (ci>cs), a value obtained by adding "1 (V)" to the variable E is set in the variable B as a new reference voltage es (E+1→E).

If the reference voltage es is determined not modifiable in step S21 (S21: NO), the CPU 81 checks whether the reference frequency fs is modifiable (S23). In this step, whether the reference frequency fs is modifiable or not is checked based on conditions which differ in which the reference volume cs is larger than the unit volume ci and which the reference volume cs is smaller than the unit volume ci.

When the reference volume cs is larger than the unit volume ci (ci<cs), it is necessary to reduce the reference volume cs by decreasing the reference parameters. In order to reduce the reference frequency fs, the reference frequency fs has to be larger than the lower limit flow read in step S18. Accordingly, if the value "f" in the variable F representing the reference frequency fs is larger than the lower limit flow (flow<f), it is possible to further reduce the reference frequency fs. The reference frequency fs is determined modifiable. If the value "f" in the variable F representing the reference frequency fs is equal to or smaller than the lower limit flow (f≦flow), it is not possible to further reduce the reference frequency fs. The reference frequency fs is determined not modifiable.

On the other hand, if the reference volume cs is smaller than the unit volume ci (ci>cs), it is necessary to increase the reference voltage cs by increasing the reference parameters. In order to increase the reference frequency fs, the reference frequency fs has to be smaller than the upper limit fup read in step S13. Accordingly, if the value "f" in the variable F representing the reference frequency fs is smaller than the upper limit fup (f<fup), it is possible to further increase the reference frequency fs. The reference frequency fs is determined modifiable. If the value "f" in the variable F representing the reference frequency fs is equal to or larger than the upper limit fup (fup≦f), it is not possible to further increase the reference frequency fs. The reference frequency fs is determined not modifiable.

If the reference frequency fs is determined modifiable in step S23 (S23: YES), the CPU 81 modifies the reference frequency fs (S24). If the reference voltage cs is larger than the unit volume ci (ci<cs), a value obtained by decreasing the scanning speed vh by a predetermined speed v0 (=vh−v0) is set as a new scanning speed vh. On the other hand, if the reference volume cs is smaller than the unit volume ci (ci>cs) and if the scanning speed vh is not the maximum scanning speed, a value obtained by increasing the scanning speed by the predetermined speed v0 (=vh+v0) is set as a new scanning speed vh. If the scanning speed vh is the maximum scanning speed, "1" is added to the variable M (M+1−M). This addition of "1" to the variable M represents increase of the number of ink drops to be ejected within the unit area. Then, the frequency f calculated based on the unit interval pi (μm) inputted in step S11, the value "m" in the variable M and the scanning speed vh (μm/s) (=m*vh/pi (kHz)) is set in the variable F as a new reference frequency fs.

After step S24 is over, or step S22 is over, the process returns to step S16.

If the reference frequency fs is not modifiable in step S23 (S23: NO), the CPU 81 checks the value in the variable N (S25).

In step S25, if the value "n" in the variable N is smaller than "3" (N<3) (S25: YES), the CPU 81 adds "1" to the variable N (N+1→N) (S26), and the process returns to step S13. As a result, steps S13 and onward are performed to the $(n+1)^{th}$ waveform. The $n^{th}$ waveform and the $(n+1)^{th}$ waveform are different in the waveform parameter, that is, discharging time t1, holding time t2 and charging time t3. Therefore, if steps S13 and onward are performed to the $(n+1)^{th}$ waveform, the waveform parameter is modified to be increased or decreased by a predetermined amount.

After steps S13–S26 are repeated and the respective reference parameters are modified, and if it is determined in step S17 that the difference between the unit volume ci and the reference volume cs is equal to or lower than the threshold th (s17: YES), the CPU 81 determines the parameters of the driving signal based on the variables N, E and F (S27). In this step. the CPU 81 determines that the waveform parameter of the driving signal is the parameter represented by the let waveform if the value in the variable N is "1". The CPU 81 determines that the waveform parameter of the driving signal is the parameter represented by the $2^{nd}$ waveform if the value in the variable N is "2". The CPU 81 determines that the waveform parameter of the driving signal is the parameter represented by the $3^{rd}$ waveform if the value in the variable N is "3". Subsequently, the CPU 81 determines the value "e" in the variable E as the driving voltage of the driving signal, and the value "f" in the variable F as the driving frequency of the driving signal. In this way, in the present parameter determination process, the reference voltage es, reference frequency fs and waveform parameter among the reference parameters are modified (steps S22; S24, S26 and S13), and the reference volume cs modified based on the respective modified reference parameters (step S16) and the unit volume ci inputted in step S11 are compared (step S17). Then, the modification of the reference parameters, modification of the reference volume cs, and comparison between the reference volume cs and the unit volume ci are repeated till the difference is equal to or lower than the threshold th. As a result, the respective reference parameters when the difference is equal to or lower than the predetermined threshold are determined as the parameters of the driving signal to be applied to the head 10.

When the value "n" in the variable N is equal to or more than "3" (3≦N) in step S25 (S25: NO), the CPU 81 determines the parameters of the driving signal based on the variables Min[0]–[2] (S28). In this step, the CPU 81 determines that the waveform parameter of the driving signal is the parameter represented by the $1^{st}$ waveform if the value in the variable Min[2] is "1". The CPU 81 determines that the waveform parameter of the driving signal is the parameter represented by the $2^{nd}$ waveform if the value in the variable Min[2] is "2". The CPU 81 determines that the waveform parameter of the driving signal is the parameter represented by the $3^{rd}$ waveform if the value in the variable Min[2] is "3". Subsequently, the CPU 81 determines the value "e" in the variable Min[0] as the driving voltage of the driving signal, and the value in the variable Min[1] as the driving frequency of the driving signal. In this way, in the present parameter determination process, if the reference parameters cannot be modified so that the difference between the reference volume cs and the unit volume ci is equal to or lower than the threshold th, the reference parameters modified so that the difference between the reference volume cs and the unit volume ci is the smallest are determined as the parameters of the driving signal to be applied to the head 10.

Then, the CPU 81 generates a control signal (S29). In this step, the control signal including instructions to generate the driving signal having the parameters determined in step S27 or S28 is generated.

After the above step, the CPU 81 outputs the control signal generated in step S29 to the head driving circuit 20 when controlling the operations of the head 10 and stage 50 in accordance with procedures in the control program. The head driving circuit 20 to which this control signal is inputted generates the driving signal having the parameters determined in step S27 or S28 and outputs the driving signal to the head 10. In this way, the head 10 to which the driving signal is inputted ejects ink drops from the respective head units 100 while traveling relative to the stage 50 at the scanning speed vh along the locus specified by the locus data to form a film over the target object attached on the stage 50.

Effects

Figure 5:
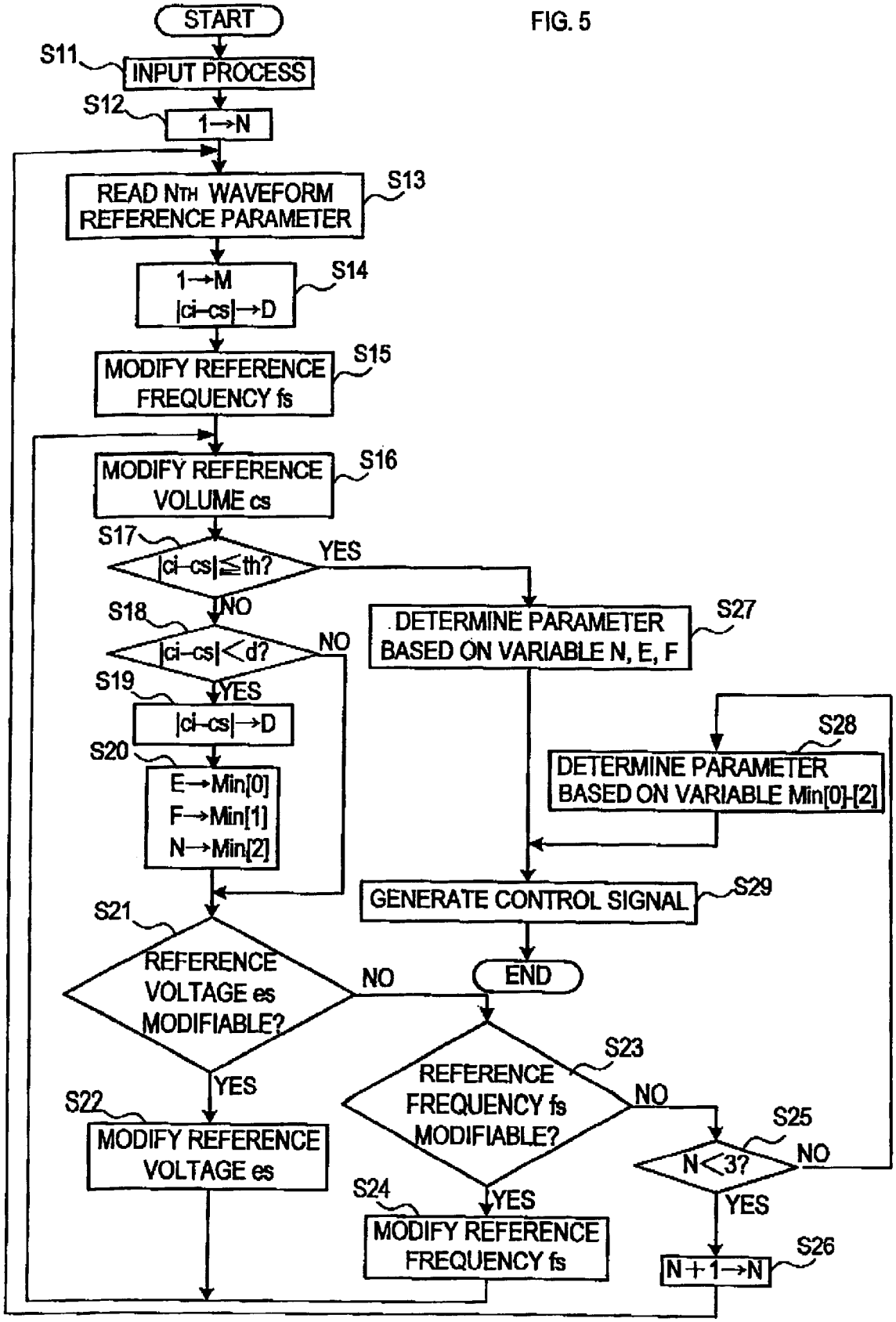
FIG. 5 is a flowchart illustrating steps for a parameter determination process.

According to the ink jet apparatus 1 constituted as such, the reference parameters are modified in steps S12 and onward based on the unit volume ci and unit interval pi inputted in step S11 in FIG. 5, and the modified reference parameters are determined as the parameters of the driving signal to be applied (outputted) to the head 10. Therefore, if the desired unit volume ci and unit interval pi are inputted in step S11, the parameters of the driving signal to be applied (outputted) to the head 10 can be easily changed based on the unit volume ci and the unit interval pi.

In step S11, the input process of the unit volume ci and unit interval pi is performed. Therefore, the parameters of the driving signal to be applied (outputted) to the head 10 can be determined based on not only the unit volume ci but also the unit interval pi.

In the parameter determination process (FIG. 6), one or more types of the reference parameters among the reference parameters such as the reference voltage es, reference frequency fs and waveform parameter are modified to be increased or decreased, and all the reference parameters including the modified reference parameter(s) can be determined as the parameters of the driving signal to be applied (outputted) to the head 10.

If the reference voltage es is determined not modifiable in step S21 and the reference frequency fs is determined modifiable in step S23, it is possible to modify the reference frequency fs in step 524. If the reference frequency fs is not modifiable in step S23 and the value "n" in the variable N is smaller than "3", steps S18 and onward are performed to the $(n+1)^{th}$ waveform. In this way, it is possible to modify the waveform parameter. Consequently, if the value "e" in the variable B representing the reference voltage es is equal to or lower then the lower limit (or is equal to or larger than the upper limit) in step S21, that is, the difference between the reference volume cs and the unit volume ci is larger than the threshold th even though the reference voltage es is decreased to the lower limit (or increased to the upper limit), it is possible to modify the reference frequency fs in step S24. Furthermore, if the value "f" in the variable F representing the reference frequency fs is equal to or lower than the lower limit (or is equal to or larger than the upper limit) in step S23, that is, the difference between the reference volume cs and the unit volume ci is larger than the threshold th even though the reference frequency fs is decreased to the lower limit (or increased to the upper limit), it is possible to modify the waveform parameter in step S13 by adding "1" to the variable N in step S26.

If the difference between the reference volume cs and the unit volume ci is larger than the threshold th even though the reference voltage es is increased to the upper limit or decreased to the lower limit in step S22, the reference frequency fs is increased or decreased in step S24. Thereby, it is possible to determine the reference parameters which allow the difference to be equal to or lower than the threshold th as the parameters of the driving signal to be applied (inputted) to the head 10 by increasing or decreasing the reference frequency fs, when the difference between the reference volume cs and the unit volume ci is not equal to or lower than the threshold th by increasing or decreasing the reference voltage es to its upper or lower limit.

Furthermore, if the difference between the reference volume es and the unit volume ci is more than the threshold th even if the reference voltage es and the reference frequency fs are increased or decreased to their upper or lower limits in step S22 or S24, the reference voltage es and the reference frequency fs are increased or decreased within the range of their upper and lower limits again so that the difference between the reference volume cs and the unit volume ci is equal to or lower than the threshold th after the waveform parameter is modified in steps S26 and S13. In this way, it is possible to determine the reference voltage es, reference frequency fs and waveform parameter that allow the difference to be equal to or lower than the threshold th by modifying the waveform parameter, even if the difference between the reference volume cs and the unit volume ci is not equal to or lower than the threshold th by the increase or decrease of the reference voltage es and reference frequency fs.

The upper and lower limits of the reference voltage es can be changed after the modification of the waveform parameter in steps S26 and S13. Accordingly, the reference voltage es can be increased or decreased within a different range before and after the modification of the waveform parameter.

If the difference between the reference volume cs and the unit volume ci is larger than the threshold th even if all of the reference voltage es, reference frequency fs and waveform parameter are modified in steps S22, S24, S26 and S13 the parameters of the driving signal are determined in step S28 based on the variables Mint[1]–[3]. These variables Min[1]–[3] hold the reference parameters when the difference between the reference volume cs and the unit volume ci is the smallest. Therefore, it is possible to determine that the reference parameters modified to minimize the difference between the reference volume as and the unit volume ci as the parameters of the driving signal to be applied (inputted) to the head 10, if the difference between the reference volume cs and the unit volume ci is more than the threshold th even if all of the reference voltage es, reference frequency fs and waveform parameter are modified.

In the parameter determination process (FIG. 5), the parameters of the driving signal, that is, the driving voltage, driving frequency and waveform parameter, can be determined.

The parameter tables hold parameters for ink of organic EL material. Accordingly, it is possible to calculate the reference volume cs for ink of organic EL material in the parameter determination process (FIG. 5).

Modifications and Variations

So far, an embodiment of the present invention has been described. However, the present invention should not be limited to the embodiment described above, and other modifications and variations may be possible.

For instance, in the above embodiment, the piezo method in which ink drops are ejected by expansion of a piezoelectric element is adopted in the head units 100 of the head 10. However, the thermal ink jet method in which ink drops are ejected by a bubble generated by a heating element can be also used in the head units 100.

In the above embodiment, the respective reference parameters, that is, the reference voltage es, reference frequency fs and waveform parameter, are modified in this order in steps S22, S24, S26 and S13 in FIG. 5. However, the order in which the respective reference parameters are increased or decreased in not necessarily limited to the above order.

In the above embodiment, the parameter tables stored in the HD 84 hold the reference parameters for ink of organic EL material to be used for forming a film over a display panel. However, the parameter tables may hold, for example, the reference parameters for conductive ink to be used for forming a circuit on an electronic board (print circuit board) or a device (element), other than the reference parameters for ink of organic EL material. In this case, it is possible to manufacture an electronic board or device having a minute circuit with better electronic properties due to the circuit formation with the conductive ink.

In the above embodiment, the ink jet apparatus 1 itself performs the parameter determination process (FIG. 5). However, another terminal apparatus (such as a computer system or another ink jet apparatus) other than the ink jet apparatus 1 may perform the parameter determination process. In this case, for example, the control signal generated by the terminal apparatus may be inputted to the ink jet apparatus 1 via wired or wireless connection. The ink jet apparatus 1 outputs the control signal inputted from the terminal to the head driving circuit 20. Moreover, when the parameters of the driving signal are determined by the terminal apparatus, data representing the parameters may be inputted to the ink jet apparatus 1 via wired or wireless connection or recording media (disk drive 87) to make the control unit 80 generate the control signal.

What is claimed is:

1. An ink jet apparatus provided with an ink jet head having a nozzle for ejecting ink drops and capable of increasing or decreasing ink drop volume ejected from the nozzle depending on parameters of a driving signal applied, the ink jet apparatus comprising:

a volume input device for inputting unit volume representing total ink drop volume to be ejected within a unit area;

a parameter determination device for determining the parameters of the driving signal to be applied to the ink jet head based on the unit volume inputted by the volume input device; and a reference volume calculation device for calculating reference volume representing the total ink drop volume ejected within the unit area when a reference driving signal having reference parameters representing a basis is applied to the ink jet head, wherein the parameter determination device modifies the reference parameters so that a difference between the reference volume and the unit volume is equal to or lower than a predetermined threshold, and determines the modified reference parameters as the parameters of the driving signal to be applied to the ink jet head.

2. The ink jet apparatus as set forth in claim 1 further comprising an interval input device for inputting a unit interval representing an interval of the unit areas, wherein said parameter determination device determines the parameters of the driving signal to be applied to the ink jet head based on said unit volume and the unit interval.

3. The ink jet apparatus as set forth in claim 1 wherein said parameter determination device modifies said reference parameters by increasing or decreasing the reference parameters within a range of upper and lower limits preset to the reference parameters.

4. The ink jet apparatus as set forth in claim 3 wherein said reference driving signal has n types of said reference parameters ($1^{st}$ to $n^{th}$ reference parameters), and said parameter determination device increases or decreases one or more types of the reference parameters within a range of upper and lower limits preset to each of the n types of the reference parameters.

5. The ink jet apparatus as set forth in claim 4 wherein said parameter determination device increases or decreases at least one of said reference parameters other than the $i^{th}$ ($i \leqq n$) reference parameter by a predetermined amount and increases or decreases the $i^{th}$ reference parameter within the range of upper and lower limits, when the difference between said reference volume and said unit volume is more than a predetermined threshold even if the $i^{th}$ reference parameter is increased or decreased to its upper or lower limit.

6. The ink jet apparatus as set forth in claim 5 wherein said parameter determination device increases or decreases at least one of said reference parameters other than said $i^{th}$ reference parameter by the predetermined amount and changes one or both of the upper and lower limits of the $i^{th}$ reference parameter according to the amount increased or decreased, and increases or decreases the $i^{th}$ reference parameter within the range of upper and lower limits.

7. The ink jet apparatus as set forth in claim 4 wherein said parameter determination device increases or decreases the $(i+1)^{th}$ reference parameter, when the difference between said reference volume and said unit volume is more than the predetermined threshold even if the $i^{th}$ ($i \leqq n$) reference parameter is increased or decreased to its upper or lower limit.

8. The ink jet apparatus as set forth in claim 1 wherein said parameter determination device determines said reference parameters modified to minimize the difference between said reference volume and said unit volume as the parameters of the driving signal to be applied to the ink jet head, when the reference parameters cannot be modified so that the difference between the reference volume and the unit volume is equal to or lower than the predetermined threshold.

9. The ink jet apparatus as set forth in claim 1 wherein said parameter determination device determines a driving voltage representing a parameter of the driving signal to be applied to the ink jet head based on said unit volume.

10. The ink jet apparatus as set forth in claim 1 wherein said parameter determination device determines a driving frequency representing a parameter of the driving signal to be applied to the ink jet head based on said unit volume.

11. The ink jet apparatus as set forth in claim 1 wherein said volume input device inputs unit volume for ink of organic EL (Electro Luminescence) material as said unit volume, and said reference volume calculation device calculates reference volume for ink of organic EL material as said reference volume.

12. A method for manufacturing organic EL (Electro Luminescence) display panel by means of an ink jet head having a nozzle for ejecting ink drops and capable of increasing and decreasing ink drop volume ejected from the nozzle based on parameters of a driving signal applied, the method comprising steps of:

inputting unit volume, representing total ink drop volume to be ejected within a unit area, for ink of organic EL material;

calculating reference volume, representing total ink drop volume ejected within the unit area, for ink of organic EL material when a reference driving signal having reference parameters representing a basis is applied to the ink jet head;

modifying the reference parameters so that a difference between the reference volume and the unit volume is equal to or lower than a predetermined threshold, and determining the modified reference parameters as the parameters of the driving signal to be applied to the ink jet head; and driving the ink jet head with the driving signal having the parameters determined in the parameter determining step.

13. The method for manufacturing organic EL display panel as set forth in claim 12 further comprising a step of inputting a unit interval representing an interval of the unit areas, wherein the parameters of the driving signal to be applied to the ink jet head are determined based on said unit volume and the unit interval in said parameter determining step.

14. The method for manufacturing organic EL display panel as set forth in claim 12 wherein said reference parameters are modified by increasing or decreasing the reference parameters within a range of upper and lower limits preset to the reference parameters in said parameter determining step.

15. The method for manufacturing organic EL display panel as set forth in claim 14 wherein said reference driving signal has n types of said reference parameters ($1^{st}$ to $n^{th}$ reference parameters), and one or more types of the reference parameters are increased or decreased within a range of upper and lower limits preset to each of the n types of the reference parameters in said parameter determining step.

16. The method for manufacturing organic EL display panel as set forth in claim 15 wherein at least one of said reference parameters other than the $i^{th}$ ($i \leqq n$) reference parameter is increased or decreased by a predetermined amount and the $i^{th}$ reference parameter is increased or decreased within the range of upper and lower limits, when the difference between said reference volume and said unit volume is more than the predetermined threshold even if the $i^{th}$ reference parameter is increased or decreased to its upper or lower limit in said parameter determining step.

17. The method for manufacturing organic EL display panel as set forth in claim 16 wherein at least one of said reference parameters other than said $i^{th}$ reference parameter is increased or decreased by a predetermined amount and one or both of the upper and lower limits of the $i^{th}$ reference parameter are changed according to the amount increased or decreased in said parameter determining step, and the $i^{th}$ reference parameter is increased or decreased within the range of upper and lower limits.

18. The method for manufacturing organic EL display panel as set forth in claim 15 wherein the $(i+1)^{th}$ reference parameter is increased or decreased when the difference between said reference volume and said unit volume is more than the predetermined threshold even if the $i^{th}$ ($i \leqq n$) reference parameter is increased or decreased to its upper or lower limit in said parameter determining step.

19. The method for manufacturing organic EL display panel as set forth in claim 12 wherein said reference parameters modified to minimize the difference between said reference volume and said unit volume are determined as the parameters of the driving signal to be applied to the ink jet head, when the reference parameters cannot be modified so that the difference between the reference volume and the unit volume is equal to or lower than the predetermined threshold in said parameter determining step.

20. The method for manufacturing organic EL display panel as set forth in claim 12 wherein at least a driving voltage representing a parameter of the driving signal to be applied to the ink jet head is determined based on said unit volume in said parameter determining step.

21. The method for manufacturing organic EL display panel as set forth in claim 12 wherein at least a driving frequency representing a parameter of the driving signal to be applied to the ink jet head is determined based on said unit volume in said parameter determining step.

22. A method for determining parameters of a driving signal applied to an ink jet head of an ink jet apparatus, the ink jet head having a nozzle for ejecting ink drops and capable of increasing and decreasing ink drop volume ejected from the nozzle based on the parameters of the driving signal to be applied, the method comprising steps of:

calculating reference volume, representing total ink drop volume ejected within a unit area, when a reference driving signal having reference parameters representing a basis is applied to the ink jet head, and modifying the reference parameters so that a difference between the calculated reference volume and unit volume representing total ink volume to be ejected within the unit area is equal to or lower than a predetermined threshold, and determining the modified parameters as the parameters of the driving signal to be applied to the ink jet head.

23. The method for determining parameters as set forth in claim 22 wherein said reference volume for ink of organic EL material is calculated, and said reference parameters are modified so that the difference between the calculated reference volume and the unit volume representing total ink drop volume to be ejected within the unit area is equal to or lower than the predetermined threshold and the modified parameters are determined as the parameters of the driving signal to be applied to the ink jet head.

24. A parameter determination program for controlling an ink jet apparatus provided with an ink jet head having a nozzle for ejecting ink drops and capable of increasing and decreasing ink drop volume ejected from the nozzle based on parameters of a driving signal applied, wherein the program makes a computer system perform steps of:

calculating reference volume representing total ink drop volume ejected within a unit area when a reference driving signal having reference parameters representing a basis is applied to the ink jet head, and modifying the reference parameters so that a difference between the reference volume calculated in the reference volume calculating step and unit volume representing total ink drop volume to be ejected within the unit area is equal to or lower than a predetermined threshold and determining the modified reference parameters as the parameters of the driving signal to be applied to the ink jet head.

25. The parameter determination program as set forth in claim 24 wherein said reference volume for ink of organic EL material is calculated, and said reference parameters are modified so that the difference between the reference volume calculated in said reference volume determining step and the unit volume, representing total ink drop volume to be ejected within the unit area, for ink of organic EL material is equal to or lower than the predetermined threshold and the modified reference parameters are determined as the parameters of the driving signal to be applied to the ink jet head in said parameter determining step.

* * * * *